US007261622B2

(12) United States Patent
Hawkins

(10) Patent No.: US 7,261,622 B2
(45) Date of Patent: Aug. 28, 2007

(54) MULTIPLE CUTTING EDGED SANDING WHEEL

(75) Inventor: James H. Hawkins, Anderson, CA (US)

(73) Assignee: Voorwood Company, Anderson, CA (US)

( * ) Notice: Subject to any disclaimer, the term of this patent is extended or adjusted under 35 U.S.C. 154(b) by 49 days.

(21) Appl. No.: 11/340,826

(22) Filed: Jan. 25, 2006

(65) Prior Publication Data

US 2006/0194527 A1 Aug. 31, 2006

Related U.S. Application Data

(63) Continuation of application No. PCT/US2004/034110, filed on Oct. 14, 2004.

(60) Provisional application No. 60/511,545, filed on Oct. 14, 2003.

(51) Int. Cl.

| | |
|---|---|
| ***B24B 23/00*** | (2006.01) |
| ***B24B 27/00*** | (2006.01) |
| *B24B 25/00* | (2006.01) |
| *B24D 11/00* | (2006.01) |

(52) U.S. Cl. ..... 451/344; 451/461; 451/538

(58) Field of Classification Search ..... 451/344, 451/461, 538, 541, 542, 548, 504

See application file for complete search history.

(56) References Cited

U.S. PATENT DOCUMENTS

| | | | | |
|---|---|---|---|---|
| 1,507,836 | A * | 9/1924 | King | 451/542 |
| 2,078,120 | A * | 4/1937 | Beth | 451/548 |
| 2,120,624 | A * | 6/1938 | Pearson | 451/496 |
| 2,720,064 | A * | 10/1955 | Klug | 451/466 |
| 2,907,145 | A * | 10/1959 | Hall et al. | 451/468 |
| 4,744,180 | A | 5/1988 | Voorhees | |
| 4,870,787 | A | 10/1989 | Voorhees | |
| 5,131,193 | A | 7/1992 | Demers | |
| 5,337,523 | A | 8/1994 | Walsh | |
| 5,380,239 | A * | 1/1995 | Casillas et al. | 451/496 |
| 5,390,449 | A | 2/1995 | Hilton | |
| 5,394,652 | A | 3/1995 | Casillas et al. | |
| 5,554,066 | A | 9/1996 | Bosten et al. | |
| 5,624,306 | A * | 4/1997 | Casillas et al. | 451/358 |
| 5,701,625 | A * | 12/1997 | Siman | 15/21.1 |
| 5,749,770 | A | 5/1998 | Uzumcu et al. | |
| 5,871,399 | A * | 2/1999 | Emerson | 451/466 |
| 6,390,900 | B1 * | 5/2002 | Susnjara | 451/178 |
| 6,439,988 | B1 | 8/2002 | Long et al. | |
| 6,500,057 | B1 | 12/2002 | Medina | |
| 6,726,546 | B2 * | 4/2004 | Christian et al. | 451/65 |
| 6,736,712 | B1 * | 5/2004 | Horn | 451/359 |
| 6,808,446 | B1 * | 10/2004 | Mosier | 451/466 |

* cited by examiner

*Primary Examiner*—Joseph J. Hail, III
*Assistant Examiner*—Alvin J. Grant
(74) *Attorney, Agent, or Firm*—John P. O'Banion

(57) ABSTRACT

An improved sanding wheel configured to rotate axially for sanding or polishing milled contours that will provide sharp edges and corners in the workpiece. The preferred sanding wheel has a cylindrical body with a plurality of segments extending radially from the body that have vertical, horizontal, angled, convex, or concave faces that match the contour of the milled workpiece. The faces of each of the segments have abrasive that may have a generally horizontal or vertical lay and the segments may be alternated. In one embodiment, equal numbers of segments with horizontal, vertical arcuate or angular faced abrasive surfaces are provided.

31 Claims, 5 Drawing Sheets

MULTIPLE CUTTING EDGED SANDING WHEEL

CROSS-REFERENCE TO RELATED APPLICATIONS

This application claims priority from, and is a 35 U.S.C. § 111 (a) continuation of, co-pending PCT international application serial number PCT/US04/34110, filed on Oct. 14, 2004, which designates the U.S., incorporated herein by reference in its entirety, Which claims priority from U.S. provisional application Ser. No. 60/511,545 filed on Oct. 14, 2003, incorporated herein by reference in its entirety.

This application is related to PCT International Publication Number WO 2005/037486 A2, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to profile sanding devices, and more particularly to an improved sanding wheel for use with a rotary disk sanding apparatus such as those disclosed in U.S. Pat. No. 4,744,180, issued May 17, 1988, to Theodore Voorhees; and U.S. Pat. No. 4,870,787, issued Oct. 3, 1989, to Theodore Voorhees; owned by the inventor. These patents are incorporated by reference herein as though set forth in full. The patents describe a cylindrical sanding wheel with abrasive operably coupled to a motor and guide and configured to sand the edge of a generally planar workpiece.

2. Description of Related Art

Motorized tools with distinctively shaped blades have been used to shape or contour the edges of wooden workpieces for use in door center panels and edges, bar and chair rails, casing, wainscots, crown moulding, window sills and the like. Such tools provide a consistent and precisely shaped edge on a plank that is far superior to what can be achieved by hand. However, in either case, the contoured edges typically require sanding in order to remove any irregularities due to the grain of the wood, knots or other imperfections and to prepare the contoured workpiece for staining or painting.

Sanding an angled edge with sandpaper by hand can produce rounded edges or grooves because of inconsistent pressure and imprecise placement of the abrasive paper. Sanding by hand is also inefficient and incompatible with large scale milling operations.

Grinding disks and sanding wheels were developed to provide consistency in the sanded surface and overall contour. Sanding wheels are typically mounted axially to a motor driven shaft. The head of the wheel has a contoured shape that engages and abrades the milled edges of the panel. The sanding wheel may be drawn across the edge of the panel or the panel drawn across the sanding wheel. Sanding belts have also been used with simple contours.

One difficulty experienced with the use of sanding disks and belts is the build up of dust on the abrasive surfaces that reduce the function of affected points on the abrasive surface and limits the useful life of the sanding disk. It is often necessary to make multiple passes over the sanding heads due to the dust build up on the abrasive surface of the belt or disk. Sections of the sanding wheel that are configured for sanding small or tight edges in the contour of a workpiece are particularly susceptible to dust buildup. Inconsistent wear or dust clogged abrasive surfaces can result in scarring of the surface of the workpiece as well as rounded corners or inside edges of the profile.

Another difficulty experienced by the sanding heads of the prior art is the imprecision found in the sanding head and sanding operation. Imprecise sanding operations can result in dulled or inconsistent edges and notches. Even with custom made sanding wheels, it is difficult to form the abrasive on the sanding wheel to match a convex sharp contour because the plane of the abrasive must form as a radius equal to the material thickness to provide a sharp edge while sanding. Consequently, multiple passes in machines with different wheels configured for different portions of the panel profile are required to cut and maintain a sharp linear edge or notch in the workpiece.

It can be seen that the need for multiple sanding wheels in several machines and several passes through the machines is both time consuming and expensive. In addition, the abrasive on the edges of the sharp corners of the sanding wheel profile experiences greater wear than the abrasive near the center of the strip greatly reducing the service life of the sanding wheel.

Replacement or repair of the sanding wheel will require the line of operations to stop to allow the wheel to be changed resulting in a loss of production time and increased expense. This productivity loss is compounded when the number of sanding wheels and sanding machines in the processing line is increased.

Accordingly, there is a need for a sanding wheel with multiple cutting edges that is resistant to the build up of abrasive dust and that will have a horizontal and vertical profile that can maintain sharp edges and grooves as well as arcuate surfaces of a workpiece. The present invention satisfies that need as well as others and generally overcomes the deficiencies in the art.

BRIEF SUMMARY OF THE INVENTION

By way of example, and not of limitation, the present invention pertains generally to a cylindrical sanding wheel with a number of cutting segments positioned around the periphery of the wheel that is adapted to be axially rotated. The sanding wheel may have a spindle or sleeve to receive a shaft that is operably attached to motor. The segments may have permanent abrasive or replaceable contoured abrasive strips that are adhered to a number of segments positioned around the periphery of the wheel. The abrasive surfaces may have strips of abrasive covered paper or may include other media such as abrasive coated cloth weaves, abrasive screens or polishing cloths and the like.

The apparatus of the invention is particularly suited for sanding the edges of planar wooden workpieces but may also be used for sanding plastics, composites and metals etc. Furthermore, the apparatus and methods may also be used for finishing and polishing with fine abrasives.

According to one aspect of the invention a sanding head is provided that has a cylindrical body configured for axial rotation and a plurality of segments radiating circumferentially from a sidewall of said cylindrical body. There is a plurality of sanding surfaces at a distal edge of said segments with an abrasive layer disposed on the sanding surfaces.

Another aspect of the invention is to provide a sanding head with a cylindrical body configured to rotate axially. The cylindrical body has a first plurality of shaped segments radiating outwardly from the periphery and the segments have at least one face. The cylindrical body also has a second plurality of shaped segments radiating outwardly from the periphery and the segments also have at least one face. The first and second segments have at least one layer of abrasive disposed on each of the faces.

A still further aspect of the invention is to provide a sanding wheel that has a plurality of segments that have abrasive on horizontal surfaces of the contour of the segment and a plurality of segments that have abrasive on the vertical surfaces of the contour and a plurality of segments that have abrasive on the convex shapes of the contour and a plurality of segments that have abrasive on the concave shapes of the contour of the workpiece.

In another aspect of the invention, a sanding wheel is provided that has segments that correspond to the profile of the workpiece that has abrasive covering arcuate, convex, horizontal and vertical sections of the segment. The lay of the abrasive on adjacent vertical and horizontal surfaces of the segment is preferably alternated from segment to segment so that a sharp edge or inside corner can be sanded. In one embodiment, the abrasive strips are perforated at a location that will allow the lay of the adhesive at the inside or outside edge of the segment contour to extend slightly beyond the segment edge.

One object of the present invention is to provide a sanding wheel that has multiple sanding faces oriented in horizontal and vertical space.

A further object of the invention is to provide a sanding wheel that has abrasive material that is formed with alternating lays to accurately sand sharp inside corner contours.

Another object of the invention is to provide a sanding wheel that can simultaneously sand multiple concave and convex angles of a workpiece with one pass.

Another object of the invention is to provide a sanding wheel that is self-cleaning and has gaps or slots that prevent the build up of sawdust, chips or abrasive dust during use.

Yet another object of the invention is to provide a sanding wheel that is inexpensive to construct and easy to use.

Another object of the present invention is to provide a sanding wheel that is easily placed and removed from a sanding machine.

Another object of the invention is to provide a sanding wheel with a plurality of segments that can be removed from the wheel and replaced with a new segment so that damaged or worn segments can be replaced with new segments without removing the sanding wheel from the apparatus.

Further objects and aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1-2 and FIG. 5A through FIG. 8B. It will be appreciated that the apparatus may vary as to configuration and as to details of the parts, and that the method may vary as to the specific steps and sequence, without departing from the basic concepts as disclosed herein.

Figure 1:
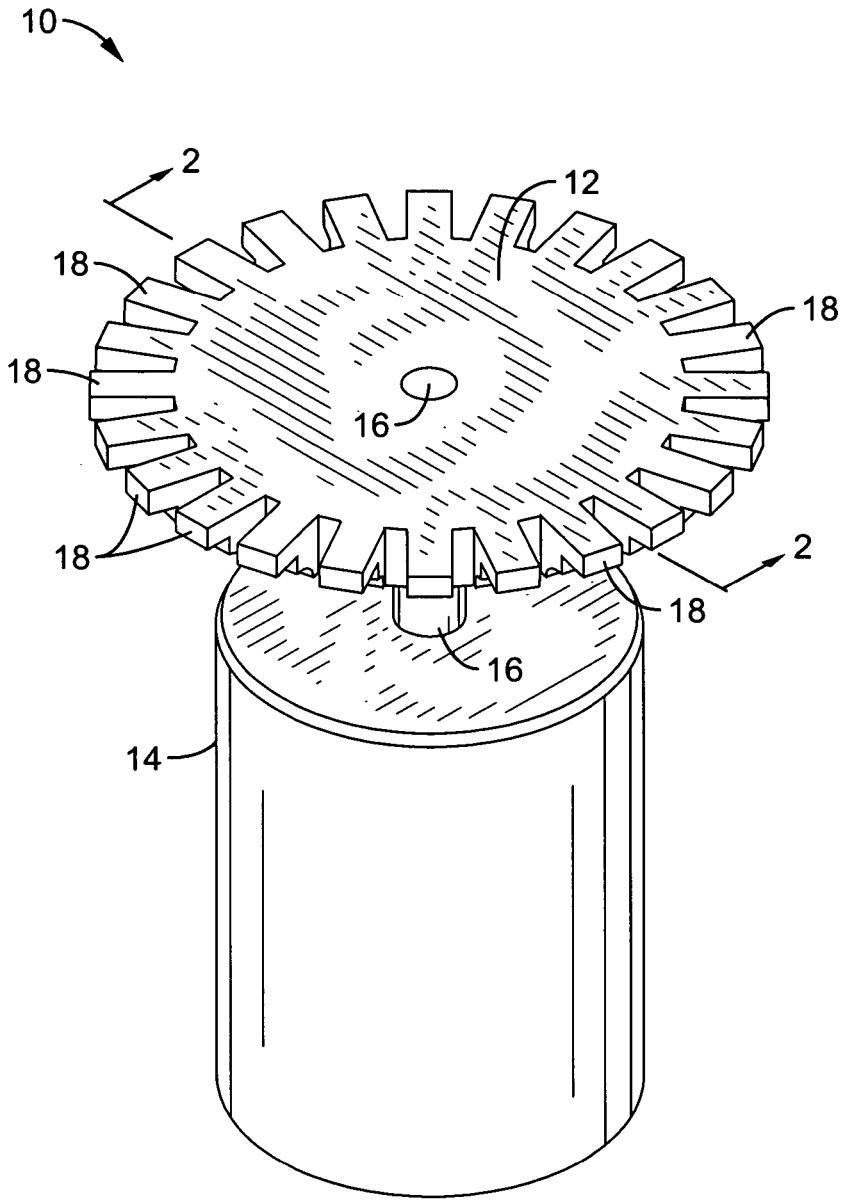
FIG. 1 is a perspective view of a sanding wheel and motor according to the present invention.
Figure 2:
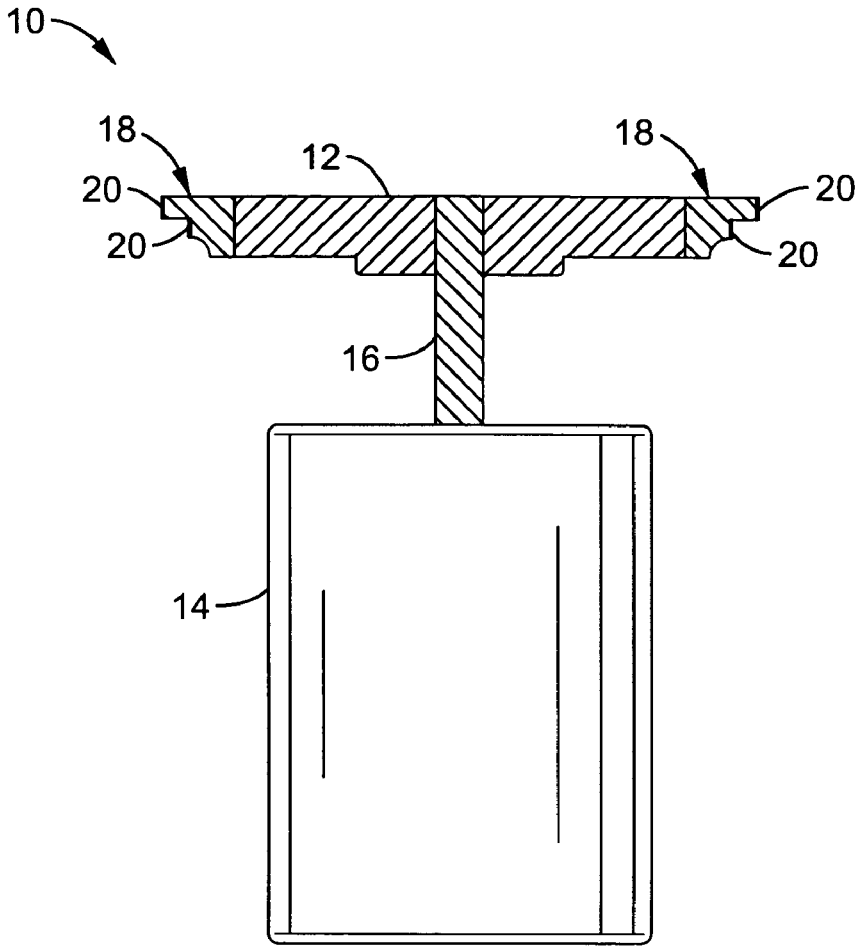
FIG. 2 is a cross-sectional view of the sanding wheel of FIG. 1 taken along the lines 2-2 of FIG. 1.

Referring first to FIG. 1 and FIG. 2, one embodiment of a sanding wheel 10 according to the present invention is generally shown. The motor mounted wheel 10 of the embodiment shown is normally associated with a set of rollers, a conveyor or a platform as part of a processing machine. These machines are designed to hold a workpiece at a proper level and orientation with respect to the sanding wheel 10 and to bring the edge of the workpiece in consistent contact with the cutting edges of the wheel over the entire length of the workpiece. Alternatively, the motor and wheel may be moved with respect to the workpiece in other machine designs.

The sanding wheel 10 has a wheel body 12 that is operably connected with a motor 14 to rotate the wheel axially during operation. In the embodiment shown in FIG. 1 and FIG. 2, the wheel body may have a socket to receive a shaft or have a spindle 16 to allow the wheel to be mounted to the motor. Although the sanding wheel body 12 may be directly mounted to a motor, it will be understood that the wheel may be indirectly connected to the motor through any number of pulleys, sprockets or gears.

Machines that utilize sanding wheels are normally adjustable in horizontal and vertical space and may be securely locked into position. The motor 14 may also have variable speeds so that the speed of rotation of the sanding wheel 10 can be varied depending on the type of sanding that is needed. The motor may also be reversible to change the direction of rotation of the sanding wheel 10.

The wheelbase 12 has a number of contoured segments 18 that extend radially from the circumference of wheelbase 12. As seen in the cross section of FIG. 2, the segments 18 have a horizontal and vertical profile that specifically corresponds to the profile of a milled workpiece in this embodiment. The segments may also have a purely horizontal profile and a purely vertical profile that corresponds to the horizontal and vertical profile of a milled workpiece. It can also be seen that the segments may be adapted to include arcuate convex and concave shapes as well as angles in the profile. Segments 18 may be permanent fixtures on the sanding body 12 or may be individually removable and interchangeable. Worn or damaged segments 18 may be replaced with new segments without the requirement of removing the wheel body 12 from the sanding machine in this embodiment. Threaded shaft or pin installation systems known in the art are preferred to secure the segments to the wheel.

Segments 18 may be made of different material than the wheel body 12. The segments are preferably made of a rigid material such as wood or metal but may also be made of plastic or a pliant material such as hard rubber.

The segments 18 may also vary in total number and size. However, an even number of like segments are preferred to provide equal exposures to each configuration of the abrasive. It is possible to configure the segments to have abrasive with characteristics that compliment the characteristics of the associated segments. Not only can the lay of the abrasive be alternated to provide a sharp corner or edge, the cutting capability of the abrasive may also be manipulated. It can be seen that the segments illustrated in FIG. 5*a* through FIG. 8*b* can have abrasive types and grit sizes that can be alternated with the segments around the periphery of the sanding wheel. In situations where simultaneous sanding with different media is beneficial, the segments may have a variety of different abrasives applied to provide the cutting surfaces. For example, one set of segments could have surfaces with abrasive paper applied and a second set of segments with abrasive impregnated cloth. In another embodiment, one set of abrasive surfaces may have abrasive of a first grit size and a second set of abrasives with a second grit size. Sandpaper with grit sizes of 80, 100, 120, 150, 180 and 220 are commonly used for sanding wood, for example. One set of segments may have a fine grit size and a second set of segments may be provided with a smaller grit size.

Figure 3:
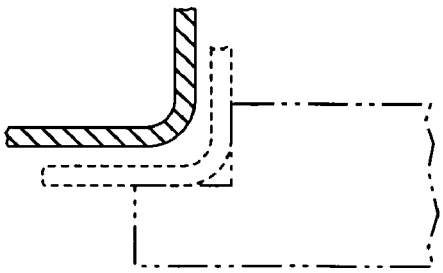
FIG. 3 (Prior Art)
FIG. 3 is a cross-sectional view of sanding disks known in the art illustrating the limitations of current abrasive contours.
Figure 4:
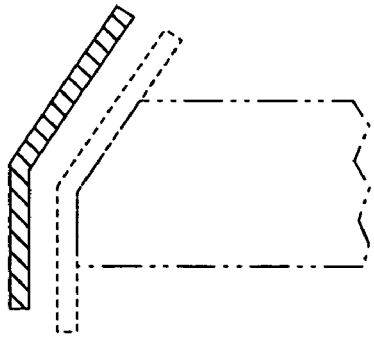
FIG. 4 (Prior Art)
FIG. 4 is a cross-sectional view of sanding disks known in the art illustrating the limitations of current abrasive contours.

One significant deficiency that is observed with prior art sanding disks is that a sharp edge or corner cannot be achieved. The mismatch between the sanding surface and the edge of the workpiece is at best equal to the radius or thickness of the abrasive on the surface of the wheel. As seen in FIG. 3, for example, a prior art sanding wheel with right angle surfaces may be used to sand a concave angular contour of a workpiece. It can be seen that the sanding wheel will not engage the inner edge of the notch or groove of the workpiece. The size of the section of the workpiece that is not sanded is approximately equal to the thickness of the abrasive on both vertical and horizontal edges of the notch. Likewise, the edges of the convex angular surfaces of a workpiece cannot have a very sharp edge because the edge will be rounded roughly the distance of the thickness of the abrasive with prior art wheels as seen in FIG. 4. The mismatch of the wheel to the groove or corner may increase when sandpaper or abrasive impregnated cloth or abrasive coated screens are used. Accordingly, it can be seen that the precision of sanding wheels is limited in the art.

Figure 5A:
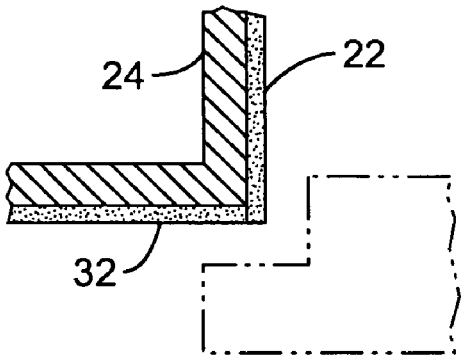
FIGS. 5A and 5B are cross sectional views of an angular segment contour of one embodiment of FIG. 1 illustrating an alternating lay of abrasive on the segments according to the invention.
Figure 5B:
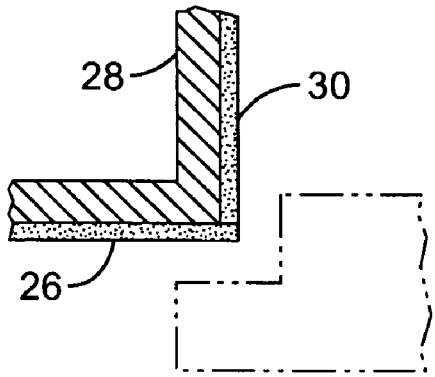

Turning now to FIG. 5A and FIG. 5B, the alternating lay of abrasive on two different segments according to the invention is shown. It can be seen that by alternating the lay of one thickness of abrasive 22 on one segment 24 with the lay of a second thickness of abrasive 26 on a second segment 28. In this illustration, a sharp contour on the workpiece can be sanded with precision because the abrasive can extend to both the horizontal and vertical surfaces of the inside corner of the contour. The full length of the vertical edge of the contour of the workpiece will engage abrasive surface 22 of segment 24 and secondarily by abrasive surface 30 of segment 28. Likewise, the horizontal surface of the contour will fully engage abrasive surface 26 of segment 28 and secondarily abrasive surface 32 of segment 24 in the embodiment shown in FIG. 5A and FIG. 5B.

Figure 6A:
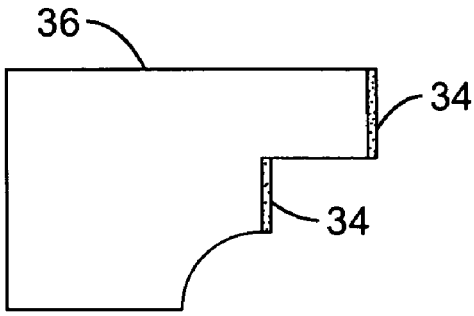
FIGS. 6A and 6B are cross-sectional views of segment contours of a two segment embodiment showing abrasive distribution on horizontal and vertical surfaces.
Figure 6B:
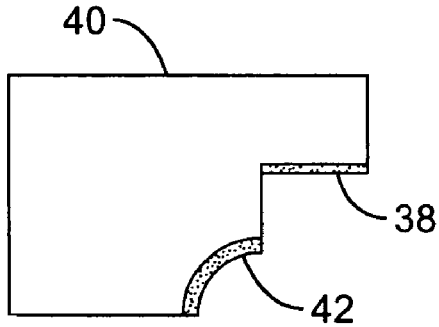

The use of multiple segments that each have a different abrasive placement on the segment profile can provide complete coverage for virtually any workpiece contour. In the embodiment shown in FIG. 6A and FIG. 6B, two segments are used to form the cutting edge of the wheel by alternating the segments around the periphery of the sanding wheel. In FIG. 6A the vertical disposition of the abrasive 34 on a first segment 36 can be seen. The vertical lay of the abrasive will permit the sharp edge of the abrasive 34 to match precisely with the corner of the contour of the workpiece. Similarly, the horizontal lay of abrasive 38 on segment 40 permits the abrasive surface 38 to match the sharp edge and corner of the workpiece. Arcuate or convex or concave angles may also be sanded with abrasive 42 extending fully to the edge of the segment 40 as shown in FIG. 6B.

Figure 7A:
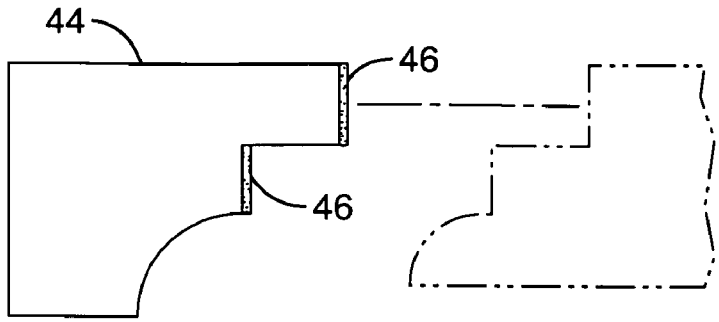
FIGS. 7A, 7B and 7C are cross-sectional views of segment contours of a three segment embodiment showing abrasive distribution on horizontal, vertical and arcuate surfaces.
Figure 7B:
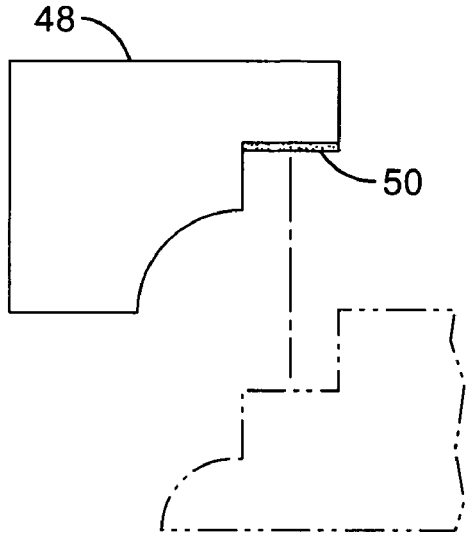
Figure 7C:
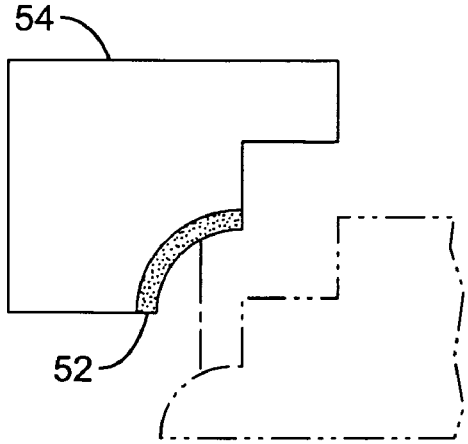

The contour of the workpiece can be divided between several segment types to allow the sanding wheel to sand the entire contour of the workpiece. In the embodiment shown in FIG. 7A, FIG. 7B and FIG. 7C, the profile is covered by the use of three different segments with different abrasive placements. In this embodiment, segment 44 has abrasive 46 disposed on the vertical surfaces. In FIG. 7B, segment 48 has abrasive 50 disposed on the horizontal surfaces of the segment profile. Abrasive 52 is placed on the arcuate surface of segment 54 as seen in FIG. 7C.

The segments 44, 48 and 54 are preferably arranged sequentially around the periphery of the sanding wheel so that each portion of the workpiece contour has approximately the same contact with abrasive during each revolution of the sanding wheel. In addition, spacing between segments as well as timing in the engagement of the abrasive with the workpiece can reduce the occurrence of particulate build up in the abrasive surfaces thereby providing the wheel with a comparatively longer useful life.

Figure 8A:
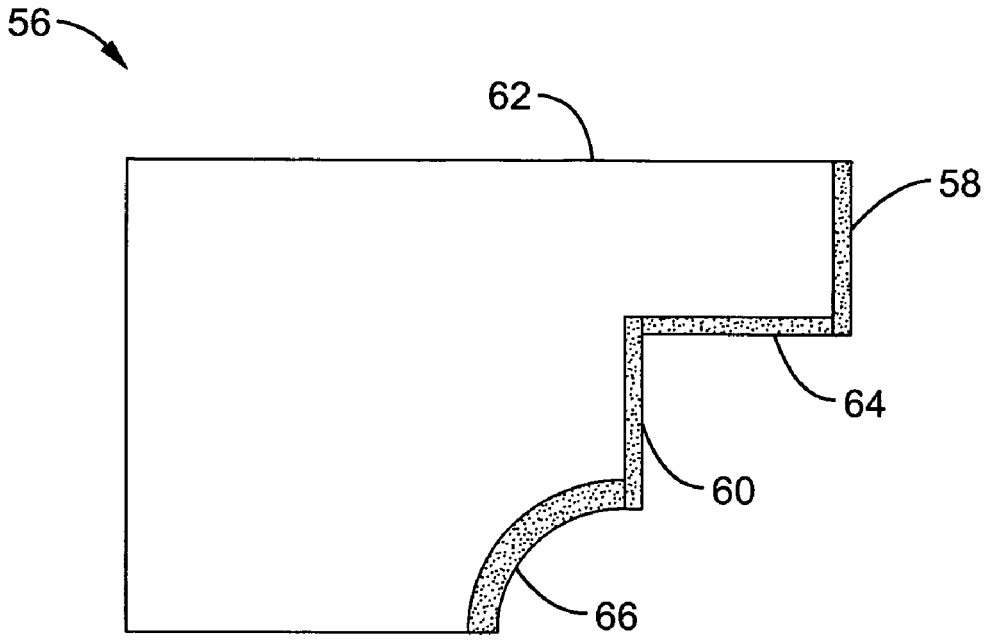
FIGS. 8A and 8B are cross-sectional views of alternating segments with a profile showing the alternative lay of adhesive according the invention.
Figure 8B:
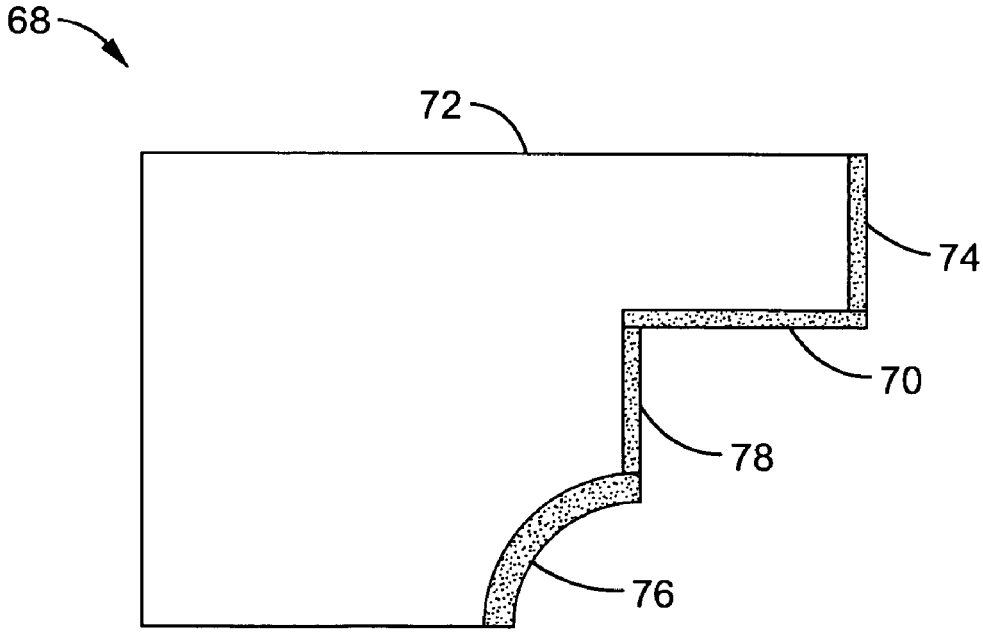

In another embodiment, shown in FIG. 8A and FIG. 8B, the lay of the abrasive of segments is alternated between two segments. In segment shown in FIG. 8A, the lay of the abrasive is in the vertical configuration according to the invention. The first segment 56 in this embodiment has abrasive with a generally vertical lay such that the edges of abrasive 58 and 60 extend slightly beyond the edge of the base 62 of the segment 56 and the edge of the horizontal abrasive 64, 66.

The alternate segment 68 shown in FIG. 8B, has a generally horizontal lay to the abrasive. It can be seen that the horizontal abrasive 70 extends slightly beyond the edge of the segment body 72 and the vertical abrasive 74. Similarly, the edge of the lower abrasive 76 extends beyond the edge of the segment body 72 and the vertical abrasive 78. In one embodiment, the abrasive is perforated so that an abrasive sheet can be bent precisely and one layer can be extended beyond the edge of the support segment. The alternate lay of abrasive in the two segments of the wheel permits the creation of sharp edges and corners as well as sand arcuate or angled surfaces on a workpiece.

Although the description above contains many details, these should not be construed as limiting the scope of the invention but as merely providing illustrations of some of the presently preferred embodiments of this invention.

Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A sanding head, comprising:

a cylindrical body configured for axial rotation;

a plurality of segments radiating circumferentially from a sidewall of said cylindrical body;

a plurality of sanding surfaces at a distal edge of said segments; and an abrasive layer disposed on said sanding surfaces;

wherein each of said plurality of segments has at least one horizontal sanding surface and at least one adjacent vertical sanding surface;

wherein said abrasive layer disposed on said horizontal sanding surface of a first plurality of shaped segments has a grit size that is larger than a grit size of said abrasive layer disposed on said horizontal sanding surfaces of a second plurality of shaped segments; and wherein said first shaped segments and said second shaped segments alternate around the circumference of said cylindrical body.

2. A sanding head, comprising:

a cylindrical body configured for axial rotation;

a plurality of segments radiating circumferentially from a sidewall of said cylindrical body;

a plurality of sanding surfaces at a distal edge of said segments; and an abrasive layer disposed on said sanding surfaces;

wherein each of said plurality of segments has at least one horizontal sanding surface and at least one adjacent vertical sanding surface;

wherein said abrasive layer disposed on said vertical sanding surface of a first plurality of shaped segments has a grit size that is larger than a grit size of said abrasive layer disposed on said vertical sanding surfaces of a second plurality of shaped segments; and wherein said first shaped segments and said second shaped segments alternate around the circumference of said cylindrical body.

3. A sanding head as recited in claim 1 or 2:

wherein said abrasive layer of said horizontal sanding surface extends beyond an edge of said sanding surface a distance approximately equal to the thickness of said abrasive layer of said vertical sanding surface.

4. A sanding head as recited in claim 1 or 2:

wherein said abrasive layer of said vertical sanding surface extends beyond an edge of said sanding surface a distance approximately equal to the thickness of said abrasive layer of said horizontal sanding surface.

5. A sanding head as recited in claim 1 or 2:

wherein said abrasive layer of said horizontal sanding surface extends beyond an edge of said sanding surface a distance approximately equal to the thickness of said abrasive layer of said vertical sanding surface of a first segment;

wherein said abrasive layer of said vertical sanding surface extends beyond an edge of said sanding surface a distance approximately equal to the thickness of said abrasive layer of said horizontal sanding surface of a second segment; and wherein a plurality of first and second segments alternate around said circumference of said cylindrical body.

6. A sanding head as recited in claim 1 or 2:

wherein said abrasive layer comprises an abrasive sheet mounted to said sanding surface.

7. A sanding head as recited in claim 1 or 2, further comprising:

a spindle axially coupled to said cylindrical body.

8. A sanding head, comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face; and at least one layer of abrasive disposed on each of said faces of said first and second segments;

wherein said faces of said first plurality of segments are oriented in a horizontal plane; and wherein said faces of said second plurality of segments are convex.

9. A sanding head, comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face; and at least one layer of abrasive disposed on each of said faces of said first and second segments;

wherein said faces of said first plurality of segments are oriented in a horizontal plane; and wherein said faces of said second plurality of segments are concave.

10. A sanding head, comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face; and at least one layer of abrasive disposed on each of said faces of said first and second segments;

wherein said faces of said first plurality of segments are convex; and wherein said faces of said second plurality of segments are concave.

11. A sanding head,comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face;

at least one layer of abrasive disposed on each of said faces of said first and second segments;

wherein said faces of said first plurality of segments are oriented in a horizontal plane; and wherein said faces of said second plurality of segments are oriented in a vertical plane;

a third plurality of shaped segments radiating outwardly from the periphery of said cylindrical body, said segments having at least one face; and an abrasive layer disposed on said face of said segment.

12. A sanding head, comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face; and at least one layer of abrasive disposed on each of said faces of said first and second segments;

wherein said abrasive layer disposed on said faces of said first plurality of shaped segments has a grit size that is larger than the grit size of said abrasive layer disposed on said faces of said second plurality of shaped segments.

13. A sanding head, comprising:

a cylindrical body configured to rotate axially;

a first plurality of shaped segments radiating outwardly from the periphery of said cylindrical body, said segments having at least one face;

a second plurality of shaped segments radiating outwardly from the periphery of said cylindrical body, said segments having at least one face; and at least one layer of abrasive disposed on each of said faces of said first and second segments;

wherein said abrasive layer disposed on said faces of said first plurality of shaped segments has a grit size that is smaller than the grit size of said abrasive layer disposed on said faces of said second plurality of shaped segments.

14. A sanding head as recited in claim 8, 9, 10, 11, 12, or 13:

wherein said faces of said first plurality of segments are oriented in a horizontal plane; and wherein said faces of said second plurality of segments are oriented in an angular plane.

15. A sanding head as recited in claim 8, 9, 10, 11, 12, or 13:

wherein said abrasive layer comprises an abrasive sheet mounted to said sanding surface.

16. A sanding head as recited in claim 8, 9, 10, 11, 12, or 13, further comprising:

a spindle axially coupled to said cylindrical body.

17. A sanding head as recited in claim 11:

wherein said faces of said third plurality of segments are arcuate.

18. A sanding head as recited in claim 17:

wherein said faces of said third plurality of segments are concave.

19. A sanding head as recited in claim 17:

wherein said faces of said third plurality of segments are convex.

20. A sanding head as recited in claim 11:

wherein said abrasive layer disposed on said face of said third plurality of shaped segments has a grit size that is smaller than the grit size of said abrasive layer disposed on said faces of said first and second plurality of shaped segments.

21. A sanding head, comprising:

a cylindrical body configured to rotate axially:

a first plurality of shaped segments radiating outwardly from the periphery of said cylindrical body, said segments having at least one face;

a second plurality of shaped segments radiating outwardly from the periphery of said cylindrical body, said segments having at least one face;

a third plurality of shaped segments radiating outwardly from the periphery of said cylindrical body, said segments having at least one face; and at least one layer of abrasive disposed on each of said faces of said first, second and third segments.

22. A sanding head as recited in claim 21:

wherein said faces of said first plurality of segments are oriented in a horizontal plane; and wherein said faces of said second plurality of segments are oriented in a vertical plane.

23. A sanding head as recited in claim 22:

wherein said faces of said third plurality of segments are arcuate.

24. A sanding head as recited in claim 22:

wherein said faces of said third plurality of segments are concave.

25. A sanding head as recited in claim 22:

wherein said faces of said third plurality of segments are convex.

26. A sanding head as recited in claim 21:

wherein each of said abrasive layers on said faces of said first, second and third plurality of segments has a different grit size.

27. A sanding head as recited in claim 21:

wherein each of said abrasive layers on said faces of said first and second plurality of segments have a different grit size than said abrasive layer on said faces of said third plurality of segments.

28. A sanding head as recited in claim 21:

wherein each of said first plurality of segments has at least one horizontal sanding surface and at least one adjacent vertical sanding surface.

29. A sanding head as recited in claim 28:

wherein said abrasive layer of said horizontal sanding surface extends beyond an edge of said sanding surface a distance approximately equal to the thickness of said abrasive layer of said vertical sanding surface.

30. A sanding head as recited in claim 28:

wherein said abrasive layer of said vertical sanding surface extends beyond an edge of said sanding surface a distance approximately equal to the thickness of said abrasive layer of said horizontal sanding surface.

31. A sanding head as recited in claim 28:

wherein said abrasive layer of said horizontal sanding surface extends beyond an edge of said sanding surface a distance approximately equal to the thickness of said abrasive layer of said vertical sanding surface of a first segment;

wherein said abrasive layer of an said vertical sanding surface extends beyond an edge of said sanding surface a distance approximately equal to the thickness of said abrasive layer of said horizontal sanding surface of a second segment; and wherein a plurality of first, second and third segments alternate around said circumference of said cylindrical body.

* * * * *